US005192028A

United States Patent [19]

Curran

[11] Patent Number: 5,192,028

[45] Date of Patent: * Mar. 9, 1993

[54] SIMPLIFIED METHOD AND APPARATUS FOR PRODUCING WHITE FLOUR FROM WHEAT GRAIN

[75] Inventor: Steven P. Curran, Manhattan, Kans.

[73] Assignee: Kansas State University Research Foundation, Manhattan, Kans.

[ * ] Notice: The portion of the term of this patent subsequent to May 19, 2009 has been disclaimed.

[21] Appl. No.: 794,241

[22] Filed: Nov. 19, 1991

Related U.S. Application Data

[63] Continuation of Ser. No. 625,085, Dec. 10, 1990, Pat. No. 5,114,079.

[51] Int. Cl.[5] ..... B02C 9/04

[52] U.S. Cl. ..... 241/3; 241/9; 241/13; 241/24; 241/29; 241/101.4; 241/159; 426/518

[58] Field of Search ..... 241/3, 6–14, 241/24, 29, 78, 79, 159, 235, 236, 101.4; 426/518

[56] References Cited

FOREIGN PATENT DOCUMENTS 2342117 3/1975 Fed. Rep. of Germany ..... 241/236

232 1/1869 United Kingdom ..... 241/13

*Primary Examiner*—Douglas D. Watts

*Attorney, Agent, or Firm*—Hovey, Williams, Timmons & Collins

[57] ABSTRACT

Apparatus and a method is disclosed for processing wheat to produce white flour by substantially removing the bran layer from the endosperm and germ portions of the wheat grain and grinding the resulting wheat product to a relatively fine state in a roll and classification train that is much simpler than prior milling equipment. Thirteen grinds with intermediate sifting are replaced with one flattening and four grinding stations and three sifts. The initially tempered wheat is passed between spaced, smooth surfaced compression rolls which flatten the wheat grains and then directed between corrugated spiral breaking rolls rotated at different rotational rates with each roll having at least 20 surface corrugations per circumferential inch. The comminuted product is then directed between corrugated spiral grinding rolls rotated at different rotational rates and each having at least 26 corrugations per circumferential inch. After selective classification through mesh sieves, the comminuted wheat is further reduced in size by passage between corrugated spiral reduction rolls having at least about 36 corrugations per circumferential inch which are also rotated at differential rotational rates. The final flour is produced by directing the comminuted product between smooth surfaced finishing rolls rotated at different rates of rotation.

50 Claims, 1 Drawing Sheet

SHORT MILLING FLOW

SIMPLIFIED METHOD AND APPARATUS FOR PRODUCING WHITE FLOUR FROM WHEAT GRAIN

This application is a continuation of application Ser. No. 07/625,085 filed Dec. 10, 1990, now U.S. Pat. No. 5,114,079.

BACKGROUND OF THE INVENTION

1. Field of the Invention

This invention relates to wheat flour milling apparatus and processes and especially to equipment and procedure for producing white flour from wheat grain which is much simpler, less costly and more efficient than previously available milling apparatus and methods.

2. Description of the Prior Art

In order to produce white flour from wheat, it is necessary that the bran outer layer be substantially removed from the internal endosperm and germ portions of the wheat grains, and that the endosperm fraction then be ground into a flour of relatively uniform constituency and particle size. The make-up of the white flour as well as its fineness and uniformity of particle size are important factors in obtaining quality products containing the flour.

Typical commercial flour mills employ a gradual reduction system of milling. Even relatively small milling units usually employ many grinding, sifting and purification passages. As many as 50 pairs of rollers may be used in comminuting the wheat grains and separating the particulate product into requisite fractions of product fineness and freedom from bran and the like, along with as many as 25 classification stations. At the very least, large commercial mills have heretofore used at least 13 separate grinds with intermediate sifting. Typically, in mills that process hard winter wheat, conditioning times of from 12 to 20 hours were common.

This means that a large capital outlay is required to build such a mill and therefore is normally more cost efficient to construct mills capable of producing large amounts of finished flour, rather than to build smaller plants in closer proximity to the producing fields themselves. Furthermore, trained personnel are required throughout the plant because of the complicated nature of the typical gradual reduction milling process. The processing apparatus is of sufficient complexity that highly trained personnel are required to operate the facility and to maintain the equipment.

As a result of the high installation and operating costs for these large mills, circumstances arise where the milling plants are located adjacent satisfactory labor markets, transportation facilities and requisite sources of utilities even though the distance between such a plant and the fields where the wheat is grown are necessarily relatively far apart.

There are circumstances though where a highly refined flour product does not meet all market needs and therefore is not saleable in a particular demographic or geographic area. For example, in many underdeveloped countries, high extraction flours (approximately 80%) are more desirable and it is very difficult for countries in this category to negotiate the purchase and construction of large mills and trained personnel or oftentimes not available to operate the plants. In addition, there are a great number of entrepreneurs in the United States who find it commercially attractive to produce their own white flour for home baking, restaurant use and similar purposes. At the present time, the only small mills available in the United States are for production of whole wheat flour exclusively.

SUMMARY OF THE INVENTION

The apparatus and method of this invention offers a simplified system for processing of wheat grain to produce a white flour. The wheat grains are initially flattened without substantial comminution thereof by passage between a pair of spaced smooth surfaced compression rolls. The flattened grain is then immediately directed into a pair of corrugated breaking rolls each having at least about 20 surface corrugations per circumferential inch of the outer circumference thereof. One of the breaking rolls is rotated at a rate about 2.4 to about 2.6 times faster than the other breaking roll.

The comminuted wheat is then immediately directed into another pair of corrugated grinding rolls each having at least about 28 corrugations per circumferential inch. The grinding rolls are rotated such that the speed of one of the grinding rolls is about 1.5 times that of the other grinding roll. The flowthrough from the grinding rolls is directed into a stacked classifier containing a series of vertically spaced mesh separators.

Bran and germ are removed from the endosperm portion in a first overhead classifier section with the throughput passing directly into the underlying second classifier section. The product retained by the screen separator of the second classifier section is sent to a pair of corrugated reduction rolls each having at least about 36 corrugations per circumferential inch and operated so that one of the rolls is rotated at a rate about 2.0 times faster than the other reduction roll. After passage of the finely comminuted flour product between a pair of smooth surfaced finishing rolls, the output is returned to the third classifier section. The overs of the third classifier (i.e., the shorts) are sent to storage or other uses, while the throughput from the third classifier is directed to reduction flour final product packaging.

The apparatus and method of this invention thus permits an operator to produce a high-extraction flour of good quality utilizing equipment which is significantly smaller in overall size and components than commercial mills heretofore available for white flour production. Cost is relatively low and construction is extremely simple. Operational requirements are minimal. Setting of the gaps between the rolls is essentially the only adjustments necessary.

The milling flow design offers great flexibility both as to positioning of the components and the nature of the final product. The output of the plant is primarily a function of the length of the rolls and the amount of sifting capacity. Simple changes in one or two sieves of the classification components permits different quality flours to be produced at the user's option.

Although the apparatus and method hereof is especially useful for processing of wheat grain, other cereal grains may be processed such as rye, corn, sorghum and buckwheat by making minor changes in the processing equipment and operating scheme.

DETAILED DESCRIPTION OF THE PREFERRED EMBODIMENT

Figure 1:
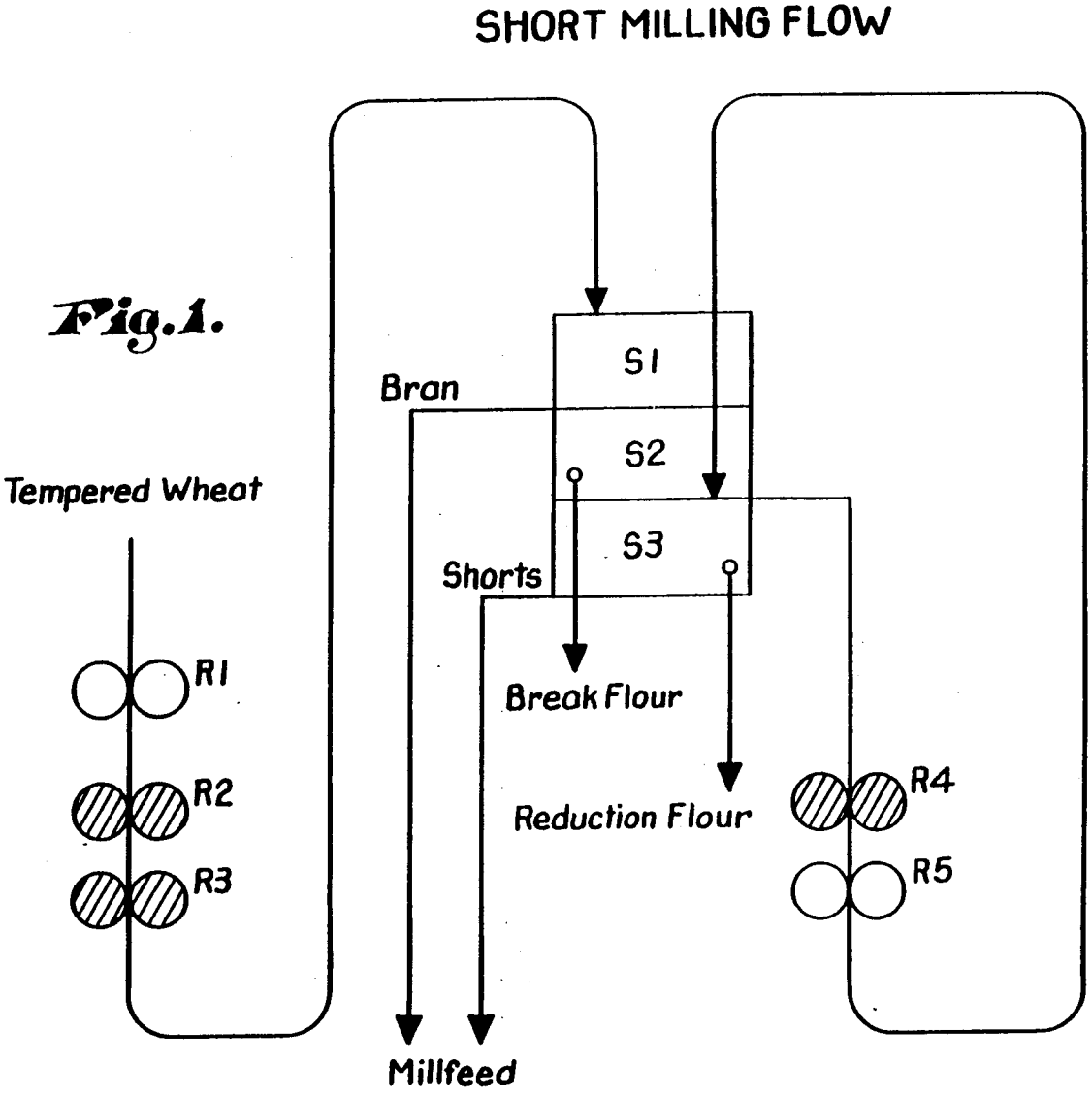
FIG. 1 is a schematic flow diagram illustrating the components of a preferred embodiment of the invention and showing the flow path of tempered wheat grains through grinding and classifying apparatus before the final product is sent to a packaging area.

Referring to FIG. 1 of the drawings, a preferred embodiment of the invention is schematically illustrated wherein tempered wheat is prepared by contacting the wheat grains with room temperature water in a mixer/-conveyor, with subsequent storage for at least about four hours. Best results are obtained when the wheat is tempered for a time period such that the total moisture content of the wheat is raised to a level of from about 14.5% to about 17% and preferably from about 15.0%.

The apparatus includes a pair of smooth surfaced compression rolls R1 positioned to directly receive the tempered wheat grains. These rolls are typically about 9 or 10 inches in diameter. The rolls are located such that the outer surfaces thereof are spaced apart a distance to flatten the wheat grains without significantly comminuting the grains. Typically, this distance is from about 0.15 to about 0.25 inches. The preferred spacing is 0.20 inch. As a consequence, there is little if any shattering of the kernels of grain.

One of the compression rolls is powered while the other one is mounted for free rotation. Preferably, there is no speed differential between the compression rolls. However, if desired, both rolls can be powered with one roll rotated at a speed such that the rpm thereof are 1.5 times that of the other compression roll. The roll which is fastest, or in circumstances where the rolls are both rotated at the same speed, the rpm thereof should be within the range of about 350 to 400 rpm.

Figure 2:
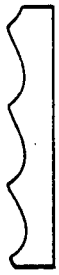
FIG. 2 is an enlarged fragmentary schematic representation of Getchell type corrugations used as the outer surface of certain of the corrugated rolls of the processing apparatus.

Passage of the wheat grains between the compression rolls R1 serves to orient the grains for delivery into the nip between a pair of spiral, corrugated surface, breaking rolls R2 which comminute the wheat and break the bran layer away from the endosperm and germ portions of the wheat grains. Each of the rolls R2 also has a diameter of about 9 or 10 inches. The rolls R2 have at least about 20 corrugations per circumferential inch with the corrugations presenting a spiral pattern wherein each spiral is deflected from a line parallel with the longitudinal axis of the respective roll one-half inch for each lineal foot of the roll. The corrugations of rolls R2 are of the Getchell type as illustrated in FIG. 2, and the orientation of the Getchell style corrugated rolls R2 is "dull to dull".

Best results are obtained when the rolls R2 are provided with at least about 24 to 26, and preferably 24, Getchell style corrugations per circumferential inch.

Rolls R2 are driven in a manner such that there is a speed differential therebetween of about 2.4 to about 2.6, and preferably about 2.5:1. The fastest of the two rolls R2 is driven at a speed of about 300 to about 700 rpm, with better results being obtained when the fastest roll is driven at a speed of about 400 rpm.

The comminuted wheat output from the rolls R2 is immediately directed into the nip between a pair of spiral, corrugated surface, grinding rolls R3. Each of the rolls R3 also has a diameter of about 9 or 10 inches. The rolls R3 have at least about 26 corrugations per circumferential inch with the corrugations presenting a spiral pattern wherein each spiral is deflected from a line parallel with the longitudinal axis of the respective roll one-half inch for each lineal inch of the roll. Best results are obtained when the grinding rolls have from 26 to 30, and preferably 28 corrugations, per circumferential inch.

The rolls R3 are driven such that one of the rolls is rotated at a speed from about 2.4 to about 2.6 and preferably 2.5:1 that of the other roll. Again the speed of the fastest roll R3 should be maintained within the range of about 300 to about 700 rpm and preferably about 400 rpm.

The corrugations of roll R3 are also of Getchell style and oriented in dull to dull relationship.

The output from grinding rolls R3 is directed into the upper end of a stacked product classifier having sieve or separation sections S1, S2 and S3. The sieve S1 is preferably provided with a floor of stainless steel mesh material providing 34 meshes per inch. Thus, each opening defined by the mesh material of sieve S1 is about 581 microns.

The sieve S2 underlying sieve S1 has a floor of stainless steel mesh material wherein there are 80 meshes per inch defining openings which are each 224 microns. The sieve S3 below sieve S2 has a floor of stainless steel mesh material the same as that of sieve S2 and thus defines 224 micron openings between the 80 meshes per inch of the stainless steel cloth.

The comminuted product from grinding rolls R3 is introduced into the top of sieve S1 as indicated by the arrow and line leading from rolls R3 to sieve S1. Bran, which is unable to pass through the corrugated mesh material of sieve S1 is separated from the endosperm and germ portions of the wheat, and is directed via the Bran line of the schematic diagram to Millfeed storage or other uses. The underflow from sieve S1 which passes through the 34 mesh material of the sieve is received in the sieve S2.

That portion of the product received in sieve S2 which will not pass through the 80 mesh cloth making up the floor of the sieve, is removed from sieve S2 and sent to a pair of reduction rolls R4. Each of the rolls R4 also has a diameter of about 9 or 10 inches. The rolls R4 preferably have about 36 corrugations per circumferential inch with the corrugations presenting a spiral pattern wherein each spiral is deflected from a line parallel with the longitudinal axis of the respective roll one-half inch for each lineal inch of the roll.

The rolls R4 are driven such that one of the rolls is rotated at a speed from about 2.0:1 that of the other reduction roll. Again the speed of the fastest roll R4 should be maintained within the range of about 300 to about 700 rpm and preferably about 400 rpm.

Figure 3:
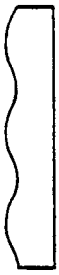
FIG. 3 is an enlarged fragmentary schematic representation of Twin City Chunk type corrugations used as the outer surface of certain other corrugated rolls forming a part of the equipment.

The corrugations of roll R4 are of Twin City Chunk style as illustrated in FIG. 3 of the drawings and are preferably oriented in "dull to dull" relationship.

The product outflow from reduction rolls R4 is directed immediately into the nip between smooth surfaced finishing rolls R5, each of which is preferably about 9 to 10 inches in diameter. The finishing rolls R5 are rotated such that one is driven at a speed about 1.5 times faster than the speed of the other. The rolls R5 are positioned so that they are in essentially contacting relationship prior to introduction of the ground product therebetween.

The output from finishing rolls R5 is directed into sieve S3. The product which will not pass through the screen of sieve S3 is removed from the sieve via the Shorts line, which may also lead to the Millfeed storage. The final product is the underflow from sieve S3 which passes through the 80 mesh screen floor thereof. This material may be sent directly to packaging or other use.

It has been found that the apparatus described herein is operable to effect about a 75% extraction of total flour based on the total product inflow to the milling equipment. The average particle size of the flour is somewhat less than 224 microns. By virtue of the nature of the milling apparatus and the simplicity of the operation, conditioning times have been reduced to periods as low as four hours.

The simplicity of the equipment and of the flow regime, as well as the low vertical height thereof allows the total system to be built in modular form occupying very little space. A dismantled mill can be transported to a remote site, erected and housed in a relatively small building. If desired, the mill can then be again dismantled and transported to another more convenient site for continuing the milling operation. In this manner, a number of small mills may be brought to strategic points of harvest or closely adjacent thereto, rather than the grain transported long distances to a central large mill.

Another feature of the equipment is the fact that certain small business in the United States and other countries specialize in marketing organically grown or otherwise identity preserved grains. Currently, there is virtually no method of milling small amounts of these materials into white flour. The present equipment and method of processing wheat particularly lends itself to this type of processing operation. Furthermore, the apparatus may be used to mill several different classes of wheat without changing the flow pattern. Different types of whole wheat flours can also be produced on the same mill in a very efficient manner.

I claim:

1. Apparatus for processing wheat to produce wheat flour by substantially removing the bran layer and germ portion from the endosperm portion of the wheat grains, said apparatus comprising:

a pair of compression rolls for receiving wheat to be processed therebetween, said compression rolls being in spaced relationship and the surfaces thereof configured to flatten the individual grains of wheat without substantial comminution thereof;

a first pair of corrugated breaking rolls positioned to receive the flattened grains of wheat directly from the compression rolls without intermediate processing of the wheat grains, and to break said wheat grains, said first breaking rolls each being provided with at least about 20 surface corrugations per circumferential inch of the outer circumference thereof;

a second pair of corrugated grinding rolls positioned to receive broken wheat grains directly from said first pair of breaking rolls, said grinding rolls each having a greater number of circumferentially arranged corrugations than the number of corrugations on said breaking rolls, said breaking rolls and grinding rolls being operable to produce a comminuted wheat product wherein the bran layer is separated from the endosperm and germ portions; and classification means for separating at least a portion of the bran fraction from the endosperm and germ portions of the comminuted wheat product.

2. Apparatus as set forth in claim 1, wherein said breaking rolls are rotated at relative rotational rates causing one of the breaking rolls to be rotated at a faster rate than the other breaking roll.

3. Apparatus as set forth in claim 2, wherein the rotational rate of the fastest breaking roll is from about 2.4 to about 2.6 times faster than the rotational rate of the slower breaking roll.

4. Apparatus as set forth in claim 2, wherein the breaking rolls have essentially the same diameter and are rotated at rotational rates such that the fastest of the two rolls is rotated at a speed from about 300 to about 700 rpm.

5. Apparatus as set forth in claim 3, wherein the breaking roll which is rotated at a faster rate than the other breaking roll is rotated at a speed of about 400 rpm.

6. Apparatus as set forth in claim 1, wherein said breaking rolls are each provided with from about 24 to about 26 corrugations per circumferential inch of a respective breaking roller.

7. Apparatus as set forth in claim 2, wherein said corrugations of each breaking roll are of spiral configuration with each spiral being deflected from a line parallel with the axis of the roll about ½ inch per longitudinal foot of the roller.

8. Apparatus as set forth in claim 1, wherein said breaking roll surface corrugations are of Getchell style.

9. Apparatus as set forth in claim 8, wherein said surface corrugations of the breaking rolls are oriented in dull to dull relationship.

10. Apparatus as set forth in claim 1, wherein said compression rolls are provided with generally smooth outer wheat-engaging surfaces.

11. Apparatus as set forth in claim 1, wherein said compression rolls are spaced in disposition such that a wheat grain receiving gap of from about 0.015 to about 0.25 in. is presented therebetween.

12. Apparatus as set forth in claim 11, wherein said compression rolls are spaced such that said gap therebetween is about 0.02 in.

13. Apparatus as set forth in claim 1, wherein said compression rolls are of essentially the same diameter and rotated at a rate such that one of the compression rolls is rotated at about 350 to 400 rpm.

14. Apparatus as set forth in claim 13, wherein said compression rolls are of essentially the same diameter and rotated at a rate such that one of the compression rolls is rotated at from about the same speed as the other compression roller to a rate 2.5 times that of the other compression roller.

15. Apparatus as set forth in claim 14, wherein the compression roller that is rotated at the fastest rpm is rotated at said speed of from about 350 to about 400 rpm.

16. Apparatus as set forth in claim 1, wherein is provided a pair of corrugated breaking rolls positioned to receive the comminuted wheat directly from the breaking rolls without intermediate processing of the wheat, said breaking rolls each having at least about 24 corrugations per circumferential inch of the outer surface of the breaking roller.

17. Apparatus as set forth in claim 1, wherein said grinding rolls each have from about 26 to 30 corrugations per circumferential inch of a respective grinding roll.

18. Apparatus as set forth in claim 17, wherein said grinding rolls each have about 28 corrugations per circumferential inch of a respective grinding roll.

19. Apparatus as set forth in claim 1, wherein said corrugations of the grinding rolls are of the Getchell type.

20. Apparatus as set forth in claim 19, wherein said surface corrugations of the grinding rolls are oriented in dull to dull relationship.

21. Apparatus as set forth in claim 1, wherein said grinding rolls are rotated at relative rotational rates causing one of the grinding rolls to be rotated at a faster rate than the other grinding roll.

22. Apparatus as set forth in claim 21, wherein the rotational rate of the fastest grinding roll is from about 2.4 to about 2.6 times faster than the rotational rate of the slower grinding roll.

23. Apparatus as set forth in claim 22, wherein the grinding rolls have essentially the same diameter and are rotated at a rotational rate such that the fastest of the two grinding rolls is rotated at a speed from about 300 to about 700 rpm.

24. Apparatus as set forth in claim 25, wherein the grinding roll which is rotated at a faster rate than the other grinding roll is rotated at a speed of about 400 rpm.

25. Apparatus as set forth in claim 1, wherein said classification means includes a first separator for sifting the comminuted wheat product received from the grinding rolls to separate bran from the endosperm and germ portions of the product.

26. Apparatus as set forth in claim 25, wherein said first separator is made up of a mesh material having about 34 mesh elements per inch.

27. Apparatus as set forth in claim 25, wherein said classification means includes a second separator oriented to receive the endosperm and germ portions of the wheat product which pass through the first separator for separating break flour from the remaining portion of the wheat product.

28. Apparatus as set forth in claim 27, wherein second separator is made up of a mesh material having about 80 mesh elements per inch.

29. Apparatus as set forth in claim 27, wherein is provided a pair of corrugated reduction rolls positioned to receive the comminuted grain product which passes through the second separator for further reducing the size of the comminuted wheat product, said reduction rolls being provided with at least about 30 surface corrugations per inch of the outer circumference thereof.

30. Apparatus as set forth in claim 29, wherein said reduction rolls are each provided with about 36 surface corrugations per circumferential inch of a respective reduction roll.

31. Apparatus as set forth in claim 29, wherein said reduction rolls are of spiral configuration with each spiral being deflected from a line parallel with the axis of a respective roll about ½ inch per longitudinal foot thereof.

32. Apparatus as set forth in claim 29, wherein said surface corrugations of the reduction rolls are of Twin City Chunk style.

33. Apparatus as set forth in claim 29, wherein said surface corrugations of the reduction rolls are oriented in dull to dull relationship.

34. Apparatus as set forth in claim 29, wherein said reduction rolls are rotated at relative rotational rates causing one of the reduction rolls to be rotated at a faster rate than the other reduction roll.

35. Apparatus as set forth in claim 34, wherein the rotation rate of the fastest reduction roll is about 2.0 times faster than the rotational rate of the slower reduction roll.

36. Apparatus as set forth in claim 34, wherein the reduction roll have essentially the same diameter and are rotated at rotational rates such that the fastest of the two rolls is rotated at a speed of from about 300 to 700 rpm.

37. Apparatus as set forth in claim 36, wherein the reduction roll which is rotated at a faster rate than the other reduction roll is rotated at a speed of about 400 rpm.

38. Apparatus as set forth in claim 29, wherein is provided a pair of finishing rolls for receiving the comminuted wheat product from the reduction rolls to further reduce the size of the particles of the comminuted wheat product.

39. Apparatus as set forth in claim 38, wherein the outer circumferentially extending surfaces of the finishing rolls are essentially smooth.

40. Apparatus as set forth in claim 39, wherein said finishing rolls are rotated at relative rotational rates causing one of the finishing rolls to be rotated at a faster rate than the other finishing roll.

41. Apparatus as set forth in claim 40, wherein the rotational rate of the fastest finishing roll is about 1.5 times faster than the rotational rate of the slower finishing roll.

42. Apparatus as set forth in claim 41, wherein the finishing rolls have essentially the same diameter and are rotated at rotational rates such that the fastest of the two rolls is rotated at a speed from about 300 to about 700 rpm.

43. Apparatus as set forth in claim 38, wherein said classification means includes a third separator for sifting the comminuted wheat product received from the second separator to further classify the comminuted wheat product to produce a reduction flour.

44. Apparatus as set forth in claim 43, wherein said third separator is made up of a mesh material having about 80 mesh elements per inch.

45. Apparatus as set forth in claim 43, wherein said separators are in disposition such that the product throughput from the first separator is received from the second separator.

46. A method of processing wheat to produce white flour by substantially removing the bran layer and germ portion from the endosperm portion of the wheat grains, said method comprising the steps of:

flattening individual wheat grains without substantial comminution thereof;

subjecting the flattened wheat grains to breaking, directly from said flattening step and without intermediate processing thereof, by passing said flattened wheat grains between a pair of closely spaced, rotating corrugated breaking rollers each having about 20 surface corrugations per circumferential inch, thereby forming a comminuted wheat product; and classifying the comminuted wheat to separate at least a portion of the bran fraction from the endosperm and germ portions thereof.

47. A method as set forth in claim 46, wherein is included the step of rotating the corrugated breaking surfaces in a manner such that one of the corrugated breaking surfaces is caused to rotate at a rate form about 2.4 to about 2.6 times faster than the speed of the opposed corrugated breaking surface.

48. A method as set forth in claim 46, wherein is included the step of further grinding the comminuted wheat prior to classification by subjecting such wheat to rotating corrugated grinding surfaces having at least about 28 corrugations per circumferential inch thereof.

49. A method as set forth in claim 48, wherein is included the step of rotating the corrugated grinding surfaces in a manner such that one of the corrugated grinding surfaces is caused to rotate at a rate from about 2.4 to about 2.6 times faster than the speed of the opposed corrugated grinding surface.

50. A method as set forth in claim 48, wherein is included the steps of subjecting the comminuted wheat to a plurality of separate classifications, and further grinding the wheat between two of the classification steps.

* * * * *

UNITED STATES PATENT AND TRADEMARK OFFICE

CERTIFICATE OF CORRECTION

PATENT NO. : 5,192,028
DATED : March 9, 1993
INVENTOR(S) : Steven P. Curran

It is certified that error appears in the above-indentified patent and that said Letters Patent is hereby corrected as shown below:

Col. 2, line 22, change "1.5" to --2.5--.
Col. 3, line 28, change "0.15" to --0.015--.
Col. 3, line 28, change "0.25" to --0.025--.
Col. 3, line 28, change "0.20" to --0.020--.
Col. 4, line 4, change "lineal inch" to --lineal foot--.
Col. 4, line 49, change "lineal inch" to --lineal foot--.

Signed and Sealed this
Fifteenth Day of March, 1994

Bruce Lehman

*Attest:*

BRUCE LEHMAN

*Attesting Officer*

*Commissioner of Patents and Trademarks*